United States Patent [19]

Powell et al.

[11] Patent Number: 5,000,010

[45] Date of Patent: Mar. 19, 1991

[54] REFRIGERATOR WITH HOT LIQUID LOOP/CASE PROTECTION

[75] Inventors: John M. Powell, Charlestown, Ind.; Louis D. Bruck, Louisville, Ky.

[73] Assignee: General Electric Company, Louisville, Ky.

[21] Appl. No.: 542,054

[22] Filed: Jun. 22, 1990

[51] Int. Cl.[5] ..... F25B 47/00

[52] U.S. Cl. ..... 62/277; 62/259.1; 62/531; 312/214

[58] Field of Search ..... 62/277, 259.1, 531; 312/296, 214

[56] References Cited

U.S. PATENT DOCUMENTS

| | | | |
|---|---|---|---|
| 2,476,906 | 7/1949 | Philipp | 62/277 |
| 2,537,314 | 1/1951 | Mortensen | 62/277 |
| 3,836,269 | 9/1974 | Koscik | 403/197 |
| 4,180,297 | 12/1979 | Abrams | 312/214 |
| 4,735,062 | 4/1988 | Woolley et al. | 62/277 |
| 4,829,145 | 5/1989 | Mitchell et al. | 174/65 G |
| 4,881,315 | 11/1989 | Powell et al. | 62/277 X |

*Primary Examiner*—Lloyd L. King

*Attorney, Agent, or Firm*—Radford M. Reams; H. Neil Houser

[57] ABSTRACT

The combination of a refrigerator cabinet, a hot refrigerant loop conduit passing through an opening in a peripheral wall of the cabinet and a grommet shielding the conduit from the edge of metal around the opening. The grommet, formed by a pair of molded body elements joined by an integral hinge, includes a pair of passages receiving portions of the conduit. Resilient rings extend into the passages and engage the conduit to preclude escape of foam insulation through the passages. An outwardly diverging mandrel extends from the refrigerated compartment end of each passage. A sealing lip projects outwardly from the grommet body and inclines toward the housing wall. Resilient fingers extend from the grommet body and have distal ends which overlap the distal edge of the sealing lip. The distal ends of the fingers and distal edge of the sealing lip engage opposite sides of the peripheral wall so the lip seals against leakage of foam through the opening.

6 Claims, 3 Drawing Sheets

REFRIGERATOR WITH HOT LIQUID LOOP/CASE PROTECTION

BACKGROUND OF THE INVENTION

This invention relates to household refrigerators and, in particular, to refrigerators which incorporate a hot liquid, anti-sweat loop.

Many current refrigerators include a freezer compartment with a door that opens to the room separate from the door for the fresh food compartment. It is normal for such freezer compartments to have a small amount of cold air leakage and/or conduction through the freezer door sealing gasket. As a result, the front face of the refrigerator housing or casing around the freezer access opening is cold. When warm, humid household air contacts this cold area moisture condenses on the front of the housing.

"Anti-sweat" heaters are installed next to the inside of the casing in these areas to prevent such condensation. A well-known manner of providing such heat is to use a hot liquid loop in a manner described hereafter. The refrigeration system includes a compressor, condenser and evaporator. The compressor compresses gaseous refrigerant and passes it to the condenser where it condenses into a liquid. The liquid subsequently passes through a capillary tube to the evaporator where heat from inside the refrigerator is used to boil the refrigerant from a liquid to a gas. The gaseous refrigerant then returns to the compressor. The condenser is an elongated tube that is formed in a serpentine and contains hot refrigerant. A portion of this tube can be used to perform the anti-sweat function. U.S. Pat. No. 4,735,062 Woolley et al, issued on Apr. 5, 1988, and assigned to General Electric Company, illustrates and describes various aspects of a refrigerator with such an anti-sweat hot liquid loop. U.S. Pat. No. 4,735,062 is incorporated herein by reference.

The compressor normally is positioned in a machinery compartment below the refrigerated spaces of the refrigerator and the condenser is normally mounted to the outside rear wall of the refrigerator cabinet or housing. Thus, it is common for the hot loop conduit to be introduced through the bottom wall or the lower portion of the rear wall of the housing. Since the freezer access opening is at the upper front portion of the cabinet, the hot liquid loop conduit is relatively long and includes a number of bends. In prior art machines the hot liquid conduit loop merely passed through an opening in the housing back wall or bottom wall. Once the conduit was properly positioned adjacent the front of the housing, the opening was closed with a putty-like material and the foam insulation was formed. Such an assembly involves several potential problems. For example, as the loop is moved about within the housing to seat it in the proper orientation it rubbed against the raw edge of the housing wall and, at least on occasions, was bent against the wall. This scored and created stress risers in the tubing that often led to subsequent failure. Also the putty-like material often was not adequate to prevent leaks of the foam insulation material. To overcome this difficulty, tape would be manually added over the outside of the putty. Such prior art systems required great care and significant manual effort and were not universally successful.

SUMMARY OF THE INVENTION

An object of the present invention is to provide an improved refrigerator anti-sweat system of the hot refrigerant loop type.

Another object of the invention is to provide such a system including a grommet which protects the conduit as it passes through the housing wall and permits assembly movement of the conduit while closing the housing opening against foam leakage.

In accordance with one embodiment of the present invention a refrigerator cabinet includes a peripheral wall adjacent a refrigerated space which has an opening for passage of the loop of refrigerant conduit and a grommet disposed in the opening. The grommet includes a body with a pair of spaced apart passages receiving separate portions of the conduit. A plurality of resilient rings extend into each passage and engage the corresponding conduit portion. An outwardly flared mandrel extends from the refrigerated compartment end of each passage to accommodate bending of the conduit. A circumferential sealing lip extends outwardly from the body and inclines toward the peripheral wall. Latch means overlaps the distal edge of the lip and the lip and latch means engage opposite sides of the peripheral wall to assure engagement of the lip with the peripheral wall.

DESCRIPTION OF THE PREFERRED EMBODIMENT

Figure 1:
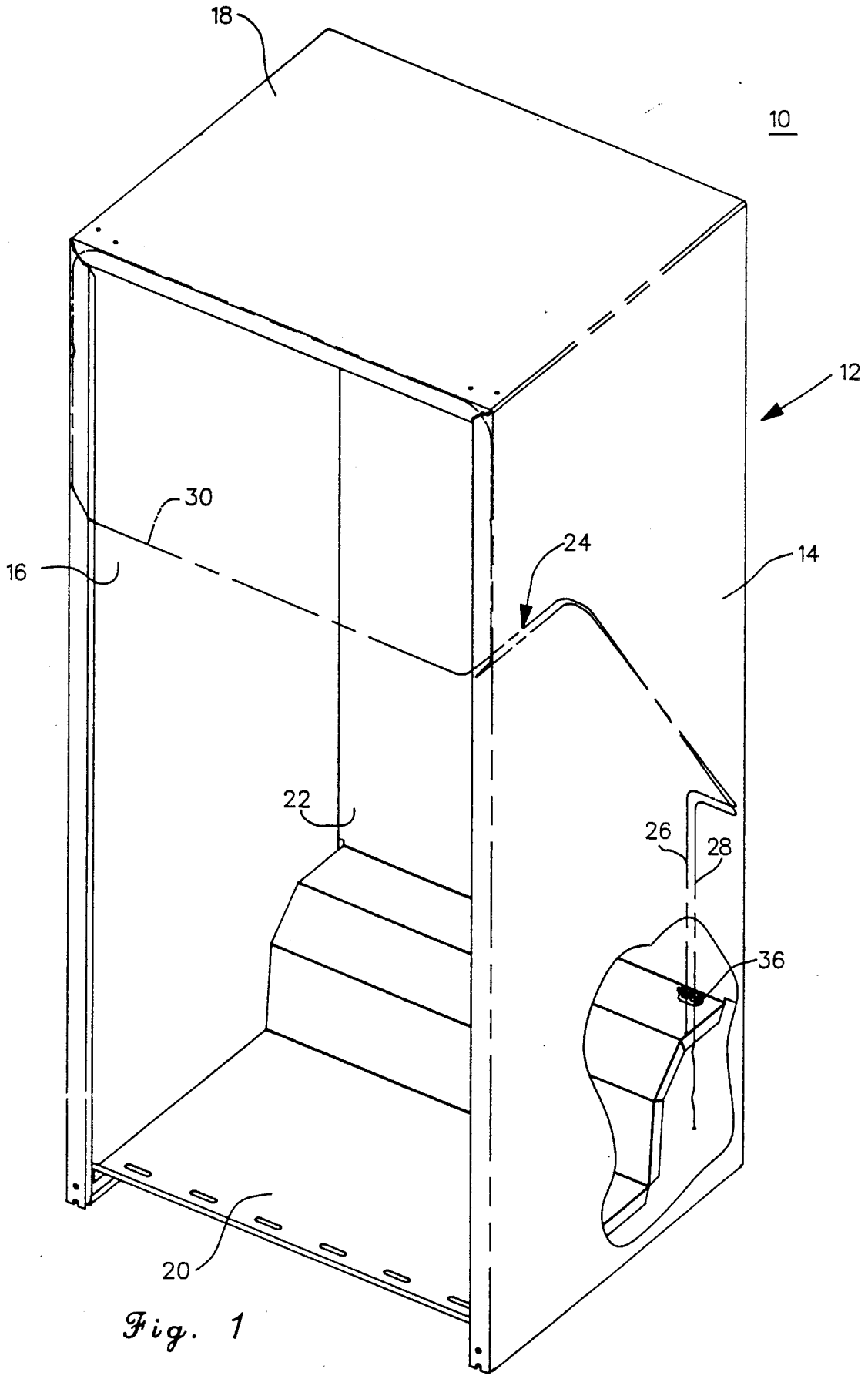
FIG. 1 is a simplified front perspective view of a refrigerator cabinet illustrating one form of the present invention, with a number of components omitted for ease of understanding.

FIG. 1 illustrates, in simplified schematic form, a refrigerator 10 with an outer metal casing or housing 12. Typically the housing is formed by a single sheet of metal which is bent into a U-shaped configuration to form side walls 14 and 16 and a top wall 18. Typically the bottom wall 20 and the rear wall 22 are formed by separate pieces of metal which are then attached to the sheet forming the sides and top wall. Typically the housing 12 is divided into a freezer compartment and a fresh food compartment, with the freezer compartment normally being in the top of the housing and the fresh food compartment toward the lower end of the housing. The bottom wall 20 separates the fresh food compartment from a machinery compartment positioned below the wall 20. For the sake of simplicity and ease of understanding, a number of components such as the inner liner which defines the freezer and fresh food compartments, the foamed-in-place insulation which normally is positioned between the outer casing or housing 12 and the liner and various controls have been omitted.

As previously explained, the front edge of the housing adjacent the freezer compartment tends to collect condensation. To prevent this, a conduit loop 24 having a first or inlet leg 26 and a second or outlet leg 28 is introduced to the inside of the housing and is positioned to have a loop portion 30 which surrounds the front of the freezer compartment. The hot refrigerant conduit 24 is attached to the outlet of the compressor and to the condenser or may form a portion of the condenser.

Various additional details of a typical refrigerator and hot refrigerant loop for preventing condensation are shown and described in the aforementioned U.S. Pat. No. 4,735,062.

Figure 2:
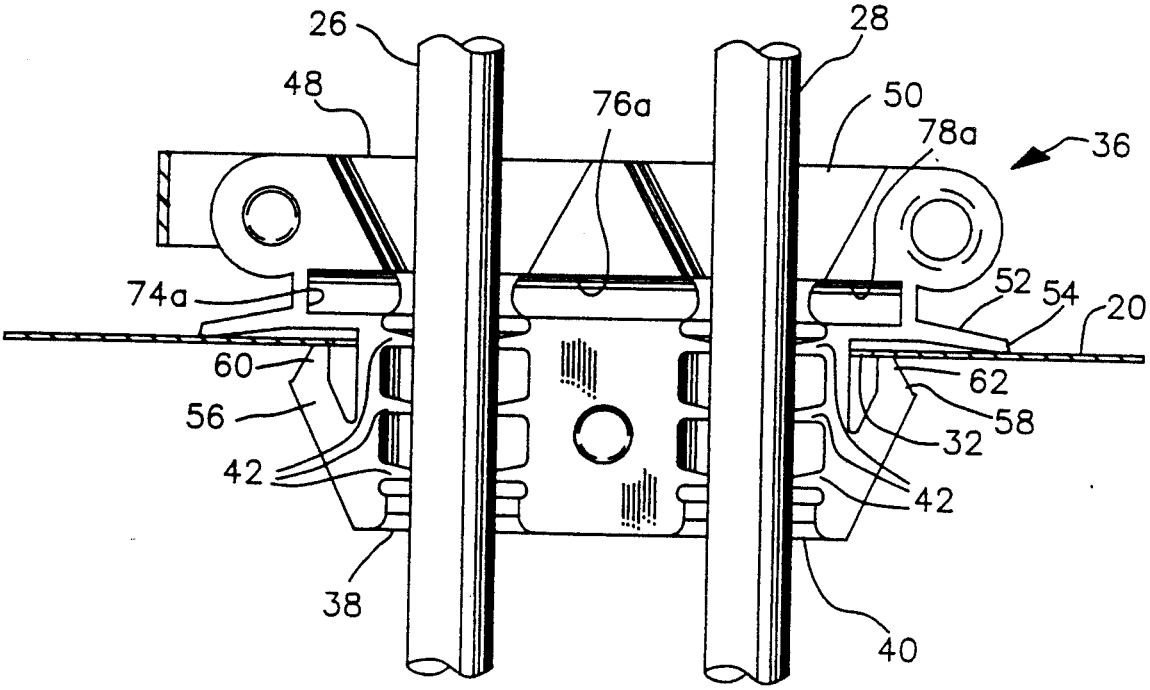
FIG. 2 is an enlarged cross-sectional view illustrating the interrelationship of the conduit, peripheral wall and grommet in accordance with the embodiment of FIG. 1.
Figure 3:
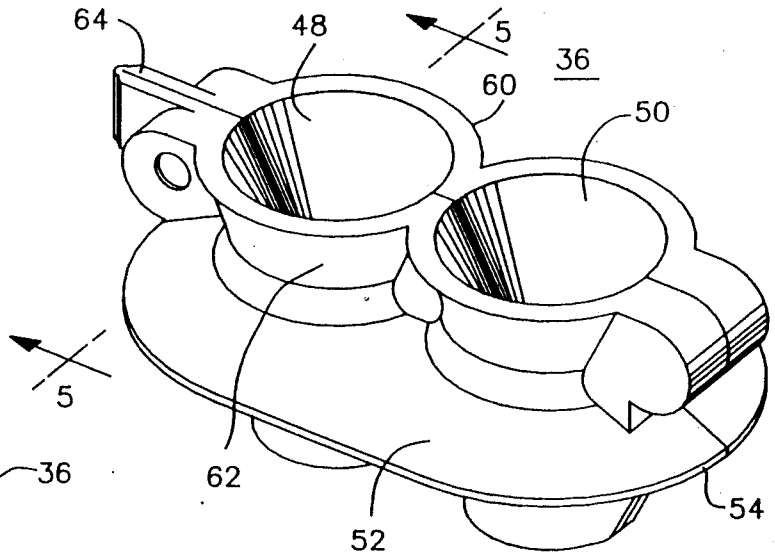
FIG. 3 is a perspective view of the grommet included in FIG. 1, with the parts of the grommet in their assembled configuration.

Access of the conduit to the interior of the housing 12 is provided by a grommet 36 which fits in an opening 32 in the bottom wall 20. Referring to FIG. 2, it will be seen that the grommet 36 includes a pair of spaced apart axially extending passages 38 and 40 which receive corresponding portions of the conduit inlet and outlet legs 26 and 28 respectively. A number of resilient rings or fingers 42 extend into the passages 38 and 40 in axially spaced apart relationship to each other and engage the outer circumference of the conduits 26 and 28 with sufficient force to prevent foam which is subsequently formed between the wall 20 and an adjacent liner from leaking through the passages. The grommet 36 includes outwardly flared mandrels 48 and 50 which connect with the refrigerated compartment end of the passages 38 and 40. The mandrels 48 and 50 provide a space in which the conduit sections 26 and 28 may bend as the conduit 24 is moved about within the housing to assure that loop portion 30 is properly seated adjacent the front of the freezer compartment. At the same time the grommet protects the conduit legs 26 and 28 from engagement with the edge of the wall 20 forming the opening 32.

Figure 5:
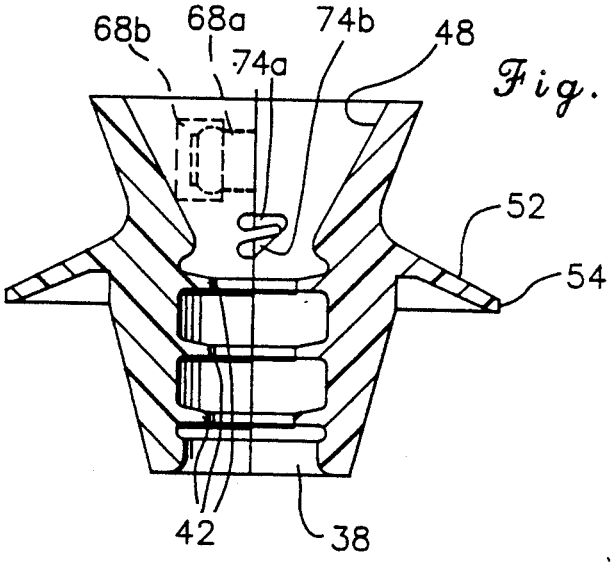
FIG. 5 is a cross-sectional view taken along line 5—5 of FIG. 3.

A sealing lip 52 extends outwardly from the body of the grommet 36 at approximately the base of the mandrels 48 and 50 and inclines toward the bottom wall 20 with the distal end 54 of the lip resting against the wall 20. Latch means in the form of a pair of resilient fingers 56 and 58 project from the machinery compartment or ambient end of the grommet 36 and extend along its periphery so that their digital ends 60 and 62 overlap the distal edge 54 of circumferential sealing lip 52. The grommet and conduit assembly is mounted in the opening 32 by inserting downwardly (as seen in FIG. 2) until the distal ends 60 and 62 of the fingers 56 and 58 pass through the opening 32. At this time, they expand outwardly to overlap the wall 20 and the distal edge 54 of lip 52 also engages the wall 20 with the lip 52 being flexed upwardly from its unstressed position as shown in FIG. 5. This assures that the lip 52 contacts the wall 20 with sufficient force to prevent foam from leaking through the opening 32 between the wall 20 and the outside of the grommet 36.

Figure 4:
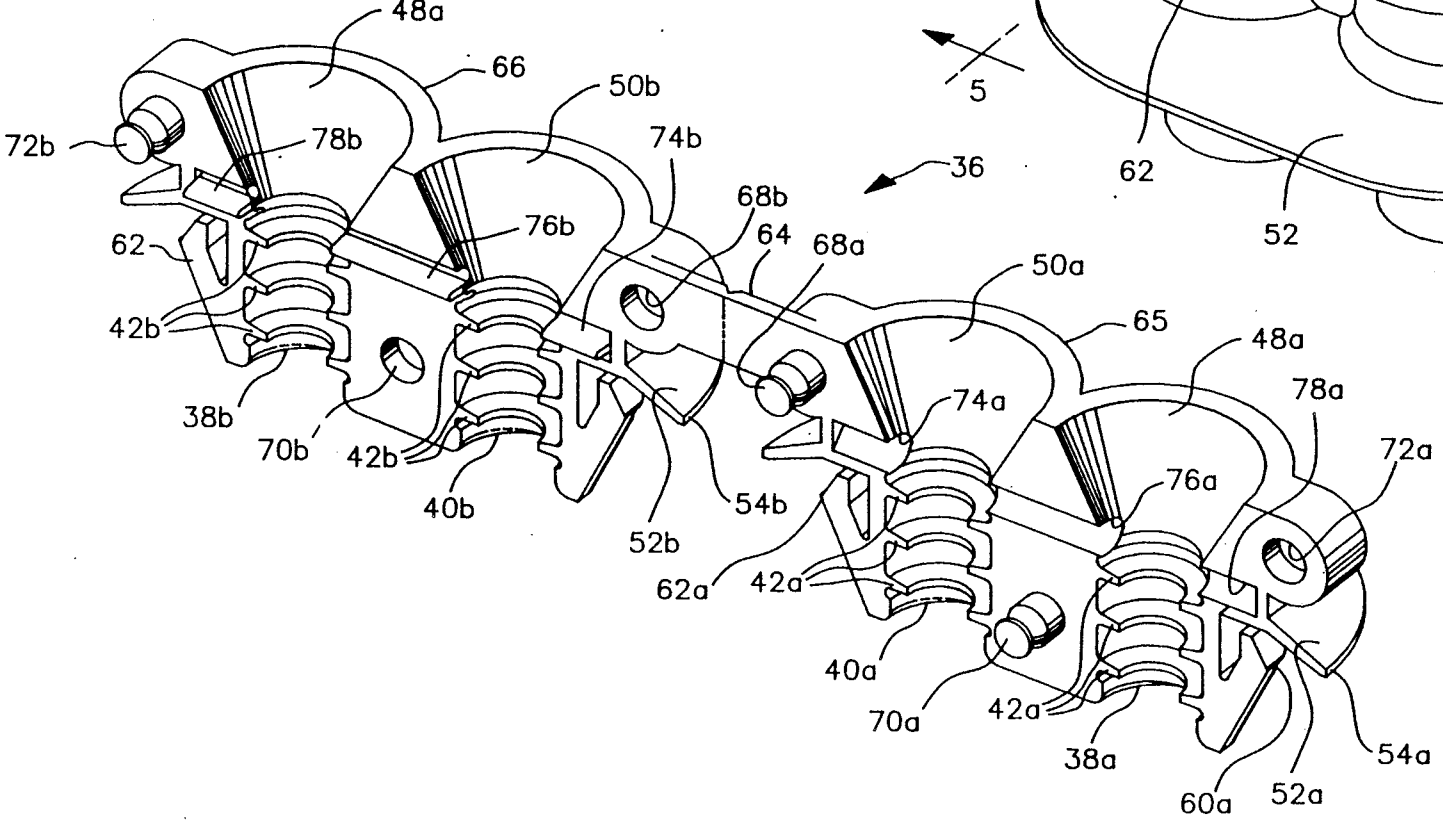
FIG. 4 is a perspective view of the grommet of FIG. 3, but with the parts of the grommet in their separated configuration.

Referring now particularly to FIG. 4, it will be seen that the grommet 36 is a body of molded plastic material such as polyethylene formed as a pair of substantially similar body elements or parts 65 and 66. A hinge 64 is molded integrally with the body elements so that they can move about the hinge from their open position, as shown in FIG. 4, to a closed or assembled position as shown in the other figures. It will be seen that each of the body elements forms half of the various portions of the grommet previously described. For example, body element 65 includes semi-circular passage portions **38*a* and 40*a*, semi-circular ring portions 42*a*, mandrel portions 48*a* and 50*a*, sealing lip portion 52*a* and finger portions 60*a* and 62*a* respectively. The corresponding half of each portion of the grommet are formed by the body element 66 and are similarly labeled using the letter "b" to designate corresponding parts. In addition the body elements are formed with locking means in the form of cooperative studs and recesses or openings to lock the body elements 60 and 62 in their closed position. More specifically, body element 65 includes studs 68*a* and 70*a*, while element 66 is formed with stud 72*b*. Element 64 is formed with recess or opening 72*a*, while element 66 is formed with recesses or openings 68*b* and 70*b*. When the elements are folded about the hinge 64 around the conduit sections 26 and 28, stud 68*a* enters opening 68*b*, stud 70*a* enters opening 70*b*, and stud 72*b* enters opening 72*a*, to firmly lock the body parts or elements 64 and 66** in their assembled positions.

In addition, element 65 is formed with recesses **74*a*, 76*a* and 78*a* while body element 66 is formed with corresponding ribs 74*b*, 76*b* and 78*b* respectively. When the body elements are folded about hinge 64 the ribs 74*b*, 76*b* and 78*b* are snugly received in the recesses 74*a*, 76*a* and 78*a*** respectively and thus assure that foam does not leak between the body elements.

The foregoing is a description of the preferred embodiment of the present invention; however, it should be understood that variations may be made thereto without departing from the true spirit and scope of the invention as defined in the appended claims.

What is claimed is:

1. In combination, a refrigerator cabinet having a peripheral wall adjacent a refrigerated space, said peripheral wall defining an opening for the passage of a loop of refrigerant conduit therethrough, and a grommet disposed in the opening, said grommet comprising:

a body having a pair of spaced apart passages extending therethrough and receiving separate portions of said conduit;

at least one resilient ring extending into each of said passages and engaging the periphery of the corresponding conduit portion;

said body also having an outwardly flared mandrel connecting with the refrigerated compartment end of each passage;

a circumferential sealing lip extending outwardly from said body and inclined toward said peripheral wall and latch means overlapping the distal edge of said lip;

said lip and said latch means engaging opposite sides of said peripheral wall to assure complete engagement between said lip and said peripheral wall.

2. The combination as set forth in claim 1 wherein said grommet is formed by a pair of complimentary parts permitting said parts to be assembled around said conduit portions.

3. The combination as set forth in claim 2 wherein said complimentary parts include locking means effective to secure said parts in their assembled configuration.

4. The combination as set forth in claim 2 wherein said latch means comprises a plurality of resilient fingers having distal ends overlapping said distal edge of said sealing lip to permit said body to be inserted through the opening in said peripheral wall until said peripheral wall is positioned between said finger distal ends and said sealing lip distal edge.

5. The combination as set forth in claim 1 wherein said grommet is formed by a pair of complimentary shaped body elements of molded polyethylene material joined by an integrally molded hinge permitting said body elements to be closed around said corresponding conduit portions and cooperative studs and recesses are formed in said body elements to secure said body elements in their closed configuration.

6. The combination as set forth in claim 5 wherein said latch means comprises a plurality of resilient fingers having distal ends overlapping said distal edge of said sealing lip to permit said grommet to be inserted through said opening in said peripheral wall until said peripheral wall is positioned between said finger distal ends and said sealing lip distal edge.

* * * * *